United States Patent [19]

Nunes

[11] 3,940,894

[45] Mar. 2, 1976

[54] BURIAL MEANS AND THE LIKE

[76] Inventor: Abner H. Nunes, 1854 Mahana St., Honolulu, Hawaii 96816

[22] Filed: Mar. 10, 1971

[21] Appl. No.: 122,780

[52] U.S. Cl. ..... 52/129; 211/71; 52/133; 52/136

[51] Int. Cl.[2] ..... A47G 29/00; E04H 13/00

[58] Field of Search ..... 52/128–141; 27/1, 2, 7; 211/71, 84

[56] References Cited

UNITED STATES PATENTS

| | | | |
|---|---|---|---|
| 481,370 | 8/1892 | Pruser | 52/139 |
| 1,617,144 | 2/1927 | Berger | 52/130 |
| 2,577,120 | 12/1951 | Franz | 211/71 |
| 3,076,292 | 2/1963 | Arbogast | 52/136 |
| 3,338,010 | 8/1967 | Waugh | 52/249 |
| 3,348,280 | 10/1967 | Myers | 27/2 |
| 3,464,171 | 9/1969 | Chandler et al. | 52/128 |
| 3,529,730 | 9/1970 | Thompson | 211/71 |
| 3,581,452 | 6/1971 | Jalbert | 52/133 |

OTHER PUBLICATIONS

The American Funeral Director, May 1965, pp. 64,66.

*Primary Examiner*—Ernest R. Purser
*Assistant Examiner*—James L. Ridgill, Jr.
*Attorney, Agent, or Firm*—James C. Wray

[57] ABSTRACT

Transparent tubular caskets are closed at one end by a shouldered plug-type cover. Pegs are driven laterally through the transparent wall into aligned holes in the cover. A central evacuating and inert gas filling hole is threaded to receive a pad-eye for lowering the tubular casket into a glass lined vertical concrete vault. The upper edge of the vault is rabbeted to receive a rabbeted concrete cover with centrally recessed decorative identification plate, which covers a threaded pad-eye receiver hole. A plurality of vaults in a honeycomb arrangement have interspaces to receive ashes and pets.

6 Claims, 5 Drawing Figures

FIG. 2
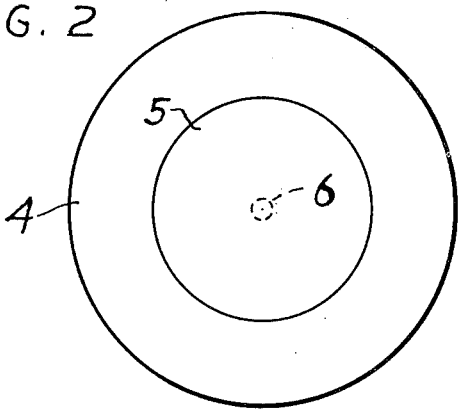
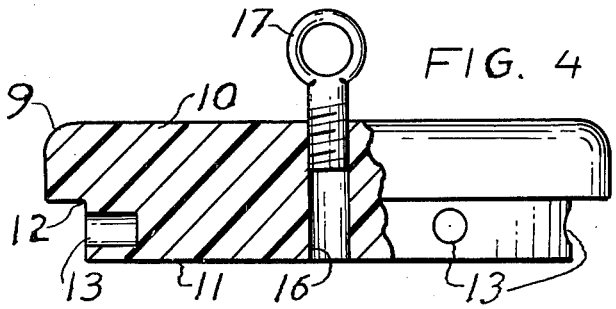
FIG. 4
FIG. 3
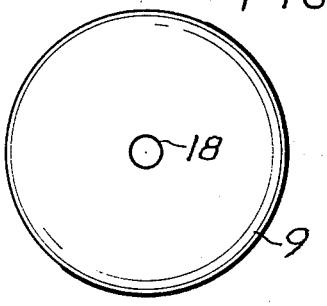
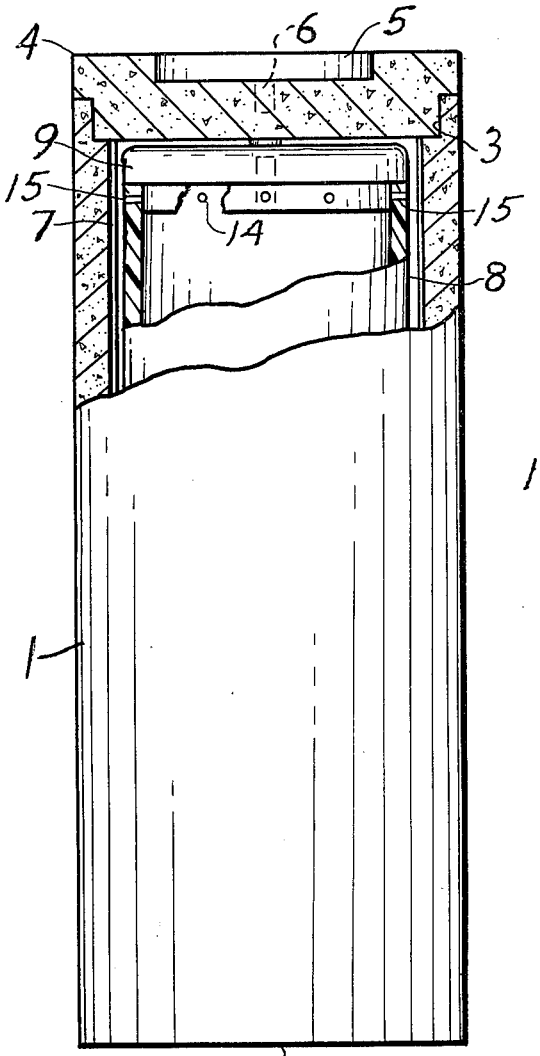
FIG. 1
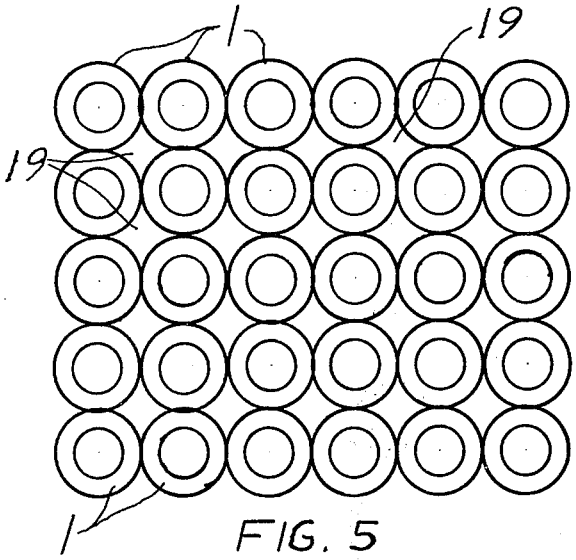
FIG. 5
INVENTOR
ABNER H. NUNES
BY
Earl E. Moore
ATTORNEY

BURIAL MEANS AND THE LIKE

This invention concerns improvement in burial caskets and means to conserve space in cemeteries and the like. Ground space for burials in many places is becoming scarce and especially where many people wish to bury their loved ones in cemeteries which have reached their capacity to accommodate more bodies under existing conditions; for instance where the boundries of cemeteries are surrounded by built-up communities such as homes and city buildings and land which cannot be acquired by purchase or because of city and state ordinances. Thus such cemeteries cannot be extended but nevertheless there is a strong demand for more space.

In accordance to the aims of this invention, three or more bodies can be respectfully buried and cared for in the space usually required for by one body. This is especially so where a single person is buried in a single grave as now generally practiced, that is, buried horizontally.

One of the principal objects of this invention is to arrange burial wherein the body is stood upright in a sealed capsule and which capsule is inverted into an upright casing that is accommodated in a hole in the ground and wherein the casing itself is also sealed. Many casings are employed in adjacent relationship and when the casings are cylindrical, a space is reserved between them for the burial of the ashes of deceased persons and/or pets.

Another object is to seal transparent capsules so that the remains of a person or pet can be viewed at times of a funeral and which capsule is provided with means so that the air can be exhausted therefrom and if desired a preserving fluid can be egressed into the capsule for there are times when it is an advantage to preserve a body for various purposes and for a long time.

A further object is to provide an economical means and system for burials along with means for economical manufacture of the capsules and the ground casings.

In the drawings:

FIG. 1 is an elevational view of a capsule within a ground casing with parts broken away to show certain parts in sectional view;

FIG. 2 is a plan view of the top portion of that shown in FIG. 1;

FIG. 3 is a top plan view of the capsule per se;

FIG. 4 is an enlarged sectional view of the closure cap means of the capsule;

FIG. 5 is a plan view of a cemetary ground area showing how a large number of upright burial sites can be arranged.

The particular form, as illustrated, shows a ground casing 1 which may be concrete or made of any other suitable material which can be economically employed for such a purpose. The casing may be of any suitable configuration such as a tube that may be round or oval, but in this case it is shown as a cylinder having the bottom 2 and an open top having a rabbet formation as indicated at 3. A cover means or capping means 4 plugs the open top of the cylinder 1, and its periphery is stepped or rabbeted to conform with the rabbet portion 3. This cover means may also be concrete or other suitable material. There is a plate 5 countersunk and perhaps removable if desired and which is for inscriptions regarding the person buried and perhaps numbered in accordance to some identification system.

This plate may be round or of any suitable configuration and may be permanently fixed in place by cement or other means. A threaded portion 6 may be provided to receive a hook or eye member so that the cover can be easily removed at time of burial. The casing is lined as shown at 7, and the lining may be glass or colored plastic material for decorative purposes and also to act as a seal to prevent entrance of ground moisture to the capsule which is shown at 8.

The capsule 8 is the casket for the body of the deceased, and means are provided to hold the body in a suitable display position whether or not this position is horizontal or vertical or some position in between. Obviously, straps or other kinds of ties may be employed for this purpose and anchored to the capsule. The capsule is made of glass or plastic material and may be colored, but in many cases the capsule is just plain clear glass or plastic of a good grade and strong enough for the purposes.

A sealing means or cover 9 is shown and consists of a round top portion 10 and an offset portion 11 as clearly shown in FIG. 4 and is an enlargement. The portion numbered 11 aids in forming the annular shoulder portion 12 which enters the capsule as a plug. This plug portion is provided with a plurality of holes or bores 13 and the top or cover rim of the capsule is provided with similar bores 14 and these bores are alined so that they can receive pegs 15 which may be plastic or of some other suitable material. The pegs are sized so that they can be tightly driven into the bores, and thus hold the top 9 to its capsule 8. Sealing means such as a suitable cement may be employed.

The capsule top cover means is provided with a bore 16 and the top portion thereof is threaded to receive the threaded end of an eye member 17 as shown in FIG. 4. The bore 6 in cover 4 of casing 1 is also provided with threads to receive the eye member 17 so that a suitable lift means is provided for raising these covers and for carrying the capsule from place to place.

The bore 16 has another use and an important one. The threaded portion of this bore 16 can be attached to or coupled with a suitable air exhausting machine so that fluid can be withdrawn from the capsule. A suitable degree of vacuum will aid in preserving the body placed in the capsule. Furthermore, an inert fluid may be forced into the capsule and this is another means for preserving the body. The item 18 is a cap designed to close the bore 16 and this cap should be cemented in place after use of the exhaust machine.

FIG. 5 shows a group of ground casings 1 which are arranged as shown, that is, to save ground space, they are placed side-by-side in close formation, and this arrangement provides spaces 19 into which ashes of deceased persons can be placed. In this case, a suitably configurative capsule is placed in these spaces 19 and then provided with a concrete cover. Obviously, the shape of the capsules, ground casings and spaces 19 will conform to some particular design and the same is true as to their associated parts such as covers etc. so that all will be in agreement and fit in the manner shown.

Obviously, various modifications and changes may be made to that disclosed without departing from the spirit and scope of the invention as described and claimed.

Having thus described my invention, what is claimed and believed new and which is desired to be secured by Letters Patent is:

1. The burial means comprising an elongated capsule having one open end is included for receiving the body of a deceased, a removable top end closure means in the open end of the capsule, and a bore through the top closure means for exhausting air in the capsule and/or injecting an embalming fluid into the capsule, wherein the top end of the capsule is provided with a plurality of laterally oriented bores and the closure means is provided with a plurality of similar laterally oriented bores, and pegs driven into the said bores when aligned for securing the closure means to the capsule in shear force across the pegs.

2. The burial means recited in claim 1 wherein the capsule has means to hold the body of a deceased inserted through the open end of the capsule in proper position for viewing purposes before the capsule is placed into a casing.

3. The burial means recited in claim 2 wherein the casing is made of cement pipe lined with a water sealing material.

4. A burial casket capsule for insertion in an upright tubular casing comprising a transparent cylindrical elongated tube having one longitudinal end integrally closed, and having an open opposite longitudinal end, means for supporting a body of a deceased person in the tube, inserted in the tube through the open longitudinal end, laterally oriented holes through the tube wall near the open end, a closure having a shoulder section which abuts the open end of the tube and a plug section integrally formed with the shoulder section, which plug section fits tightly within the tube near its open end, openings extending laterally through the tube wall adjacent the plug section, and complementary openings laterally extending into the plug section and fastening means extending through the tube openings and into the plug section openings.

5. The burial casket capsule of claim 4 further comprising a fluid passageway extending axially through the closure to an interior of the tube for passing fluid out of and into the closed tube and plug means for sealing the fluid passageway.

6. The burial casket capsule of claim 4 further comprising a threaded pad-eye receiver hole in the closure for removably receiving a pad-eye for lowering the closed capsule into a tubular casing.

* * * * *